US009476289B2

(12) United States Patent
Wells

(10) Patent No.: US 9,476,289 B2
(45) Date of Patent: Oct. 25, 2016

(54) IN-LINE ADAPTER FOR A PERFORATING GUN

(71) Applicant: G&H Diversified Manufacturing LP, Houston, TX (US)

(72) Inventor: Joe Noel Wells, Lindale, TX (US)

(73) Assignee: G&H DIVERSIFIED MANUFACTURING LP, Houston, TX (US)

( * ) Notice: Subject to any disclaimer, the term of this patent is extended or adjusted under 35 U.S.C. 154(b) by 472 days.

(21) Appl. No.: 14/025,387

(22) Filed: Sep. 12, 2013

(65) Prior Publication Data

US 2015/0068723 A1 Mar. 12, 2015

(51) Int. Cl.
*E21B 43/1185* (2006.01)
*E21B 33/134* (2006.01)

(52) U.S. Cl.
CPC ..... *E21B 43/1185* (2013.01); *E21B 33/134* (2013.01)

(58) Field of Classification Search
CPC ... E21B 23/06; E21B 33/134; E21B 43/1185
See application file for complete search history.

(56) References Cited

U.S. PATENT DOCUMENTS 3,398,803 A * 8/1968 Leutwyler ..... E21B 23/065 166/297
5,396,951 A 3/1995 Ross
5,531,164 A 7/1996 Mosley
5,908,365 A 6/1999 LaJaunie et al.
6,164,375 A * 12/2000 Carisella ..... E21B 23/04 166/373
6,433,991 B1 * 8/2002 Deaton ..... E21B 23/00 166/65.1
8,079,296 B2 12/2011 Barton et al.
2004/0055749 A1 * 3/2004 Lonnes ..... E21B 23/04 166/298
2008/0128133 A1 6/2008 Turley et al.
2009/0194277 A1 8/2009 Burnett et al.
2012/0024519 A1 2/2012 Ferguson et al.

FOREIGN PATENT DOCUMENTS

EP 01060449 A1 6/1985
EP 0925423 B1 12/2003
WO WO2009/085341 A2 7/2009
WO WO2012/027492 A2 3/2012

OTHER PUBLICATIONS

International Application No. PCT/US2014/055080, International Search Report and Written Opinion dated Dec. 22, 2014, 11 pages.
Weatherford Brochure; "Weatherford, Real Results, Plug-and-Shoot Diverter Valve Enables Casing Perforation at Proper Depth, Eliminates Premature Detonation, Saves $1 Million," weatherford.com; 2011.

* cited by examiner

*Primary Examiner* — William P Neuder
(74) *Attorney, Agent, or Firm* — Conley Rose, P.C.

(57) ABSTRACT

A plug and shoot assembly including a perforating gun to perforate a subterranean wellbore, a setting tool to install a plug within the wellbore, and an adapter configured to connect to each of the perforating gun and the setting tool. The adapter includes a single outer housing, the outer housing further including a first end to directly connect to the perforating gun, a second end to directly connect to the setting tool, and an internal passage extending between the first and second ends of the outer housing. In addition, the adapter includes a diode housing disposed within the internal passage and configured to receive a diode member, and an internal contact assembly also disposed within the internal passage. The internal contact assembly is configured to route an electrical signal to cause the setting tool to install a plug within the wellbore.

13 Claims, 7 Drawing Sheets

IN-LINE ADAPTER FOR A PERFORATING GUN

STATEMENT REGARDING FEDERALLY SPONSORED RESEARCH OR DEVELOPMENT

Not applicable.

BACKGROUND

During completion operations for a subterranean wellbore, it is conventional practice to perforate the wellbore and any casing pipes disposed therein with a perforating gun at each production zone to provide a path(s) for formation fluids (e.g., hydrocarbons) to flow from a production zone of a subterranean formation into the wellbore. To ensure that each production zone is isolated within the wellbore, plugs, packers, and/or other sealing devices are installed within the wellbore between each production zone prior to perforation activities. In order to save time as well as reduce the overall costs of completion activities, it is often desirable to simultaneously lower both a setting tool and at least one perforating gun along the same tool string within the wellbore in order to set the sealing device as well as perforate the wellbore in a single trip down hole.

SUMMARY

Embodiments are disclosed that provide an adapter housing to couple a perforating gun and a setting tool to one another along a tool string to carry out completion activities for a subterranean well. Some embodiments are directed to a plug and shoot assembly. In an embodiment, the plug and shoot assembly includes a perforating gun to perforate a subterranean wellbore. In addition, the plug and shoot assembly includes a setting tool to install a plug within the wellbore. Further, the plug and shoot assembly includes an adapter configured to connect to each of the perforating gun and the setting tool. The adapter includes a single outer housing, the outer housing including a first end to directly connect to the perforating gun, a second end to directly connect to the setting tool, and an internal passage extending between the first end and the second end of the outer housing. In addition, the adapter includes a diode housing disposed within the internal passage and configured to receive a diode member. Further, the adapter includes an internal contact assembly also disposed within the internal passage. The internal contact assembly are configured to route an electrical signal to cause the setting tool to install a plug within the wellbore.

Other embodiments are directed to a plug and shoot firing head adapter for a downhole tool string. In an embodiment, the plug and shoot firing head adapter includes a single outer housing, the outer housing including a first end to directly connect to a perforating gun, a second end to directly connect to a setting tool, and an internal passage extending between the first end and the second end of the outer housing. In addition, the plug and shoot firing head adapter includes a diode housing disposed within the internal passage and configured to receive a diode member that is further configured to selectively route an electrical signal to cause the setting tool to install a plug within the wellbore and to cause the perforating gun to perforate the wellbore.

Still other embodiments are directed to a plug and shoot assembly. In an embodiment, the plug and shoot assembly includes a perforating gun to perforate a subterranean wellbore, and a setting tool to install a plug within the subterranean wellbore. In addition, the plug and shoot assembly includes an adapter configured to connect the perforating gun and the setting tool to one another. The adapter includes a single outer housing, the outer housing having a central axis and including a first end, a second end opposite the first end, and an internal passage extending between the first end and the second end, wherein the first end comprises a first set of external threads to engage with a corresponding set of internal threads on the perforating gun, wherein the second end comprises a second set of external threads to engage with a corresponding set of internal threads on the setting tool. In addition, the adapter includes a diode assembly configured to be disposed within the internal passage. Further, the adapter includes an internal contact assembly also configured to be disposed within the internal passage axially below the diode assembly. The inner contact assembly includes an upper contact, a lower contact, and a biasing member in contact with each of the upper contact and the lower contact. Each of the upper contact, the lower contact, and the biasing member are configured to conduct electrical current therethrough. The diode assembly is configured to route an electrical signal of a first polarity to a first firing assembly to cause the setting tool to install a plug within the wellbore and to route an electrical signal of a second polarity to a second firing assembly to cause the perforating gun to perforate the wellbore. The first polarity is opposite the second polarity.

BRIEF DESCRIPTION OF THE DRAWINGS

For a detailed description of the preferred embodiments of the invention, reference will now be made to the accompanying drawings in which.

DETAILED DESCRIPTION

Figure 1:
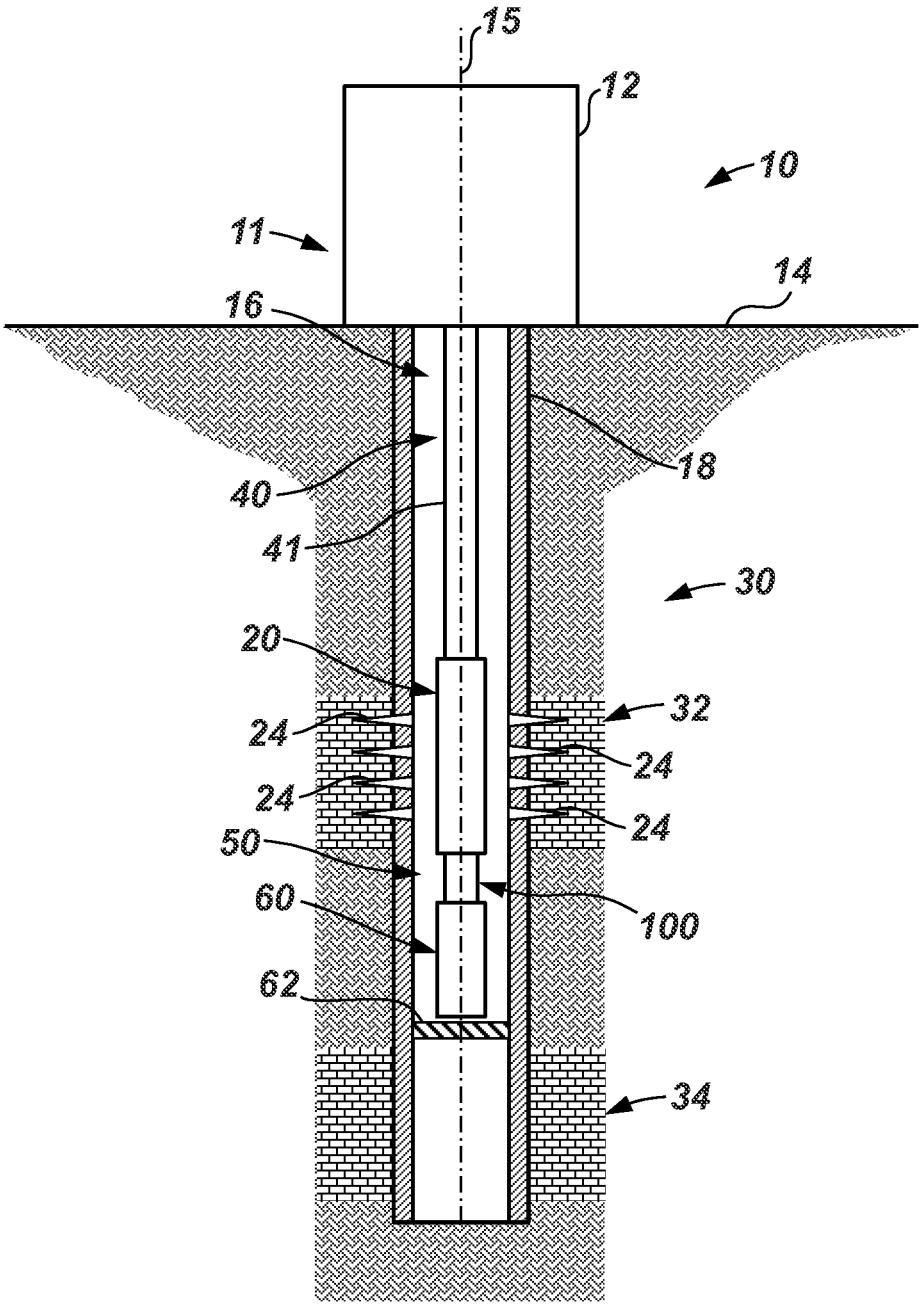
FIG. 1 is a schematic, partial cross-sectional view of a system for completing a subterranean well including a plug and shoot firing head adapter in accordance with the principles disclosed herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation.

As previously described, during completion activities, it is often desirable to simultaneously lower both a setting tool and a perforating gun into a subterranean wellbore. During conventional activities, a large number of separate components and/or adapter pieces are coupled between the setting tool and the perforating gun along the tool string to both physically couple the setting tool and perforating gun to one another as well as hold the various electrical and/or mechanical components necessary to fire or actuate both of the setting tool and the perforating gun. This relatively large number of adapter pieces disposed between the setting tool and the perforating gun increases the number of components included within the tool string and thus increases the risk of failures (e.g., loss of containment) as well as increases the overall length of the tool string, thereby limiting the effectiveness of such equipment during completion operations. In addition, because of the excessive length of tool strings employing conventional adapter pieces between the perforating gun and the setting tool, it is often difficult to negotiate or maneuver such tool strings through deviations along the borehole (e.g., deviations that occur in wells drilled utilizing horizontal drilling techniques). Embodiments disclosed herein include a plug and shoot firing head adapter that includes a single, integrated housing coupling a perforating gun and a setting tool to one another along a tool string thereby decreasing the number of required components disposed along the tool string during combined plugging and perforation activities. Through use of firing head adapter in accordance with the principles disclosed herein, a setting tool may be coupled to a perforating gun along a tool string with a single integrated housing such that the overall length of the tool string may be reduced, thereby increasing the maneuverability of the tool string when it is deployed downhole. Additionally, through use of a firing head adapter in accordance with the principles disclosed herein, the number of components required for carrying out combined perforation and plugging activities may be reduced, thus reducing the failure rate and complexity of such operations.

Referring now to FIG. 1, a system 10 for completing a well 11 having a wellbore 16 extending into a subterranean formation 30 along a longitudinal axis 15 is shown. In this embodiment, formation 30 includes a first or upper production zone 32 and a second or lower production zone 34. System 10 generally comprises a surface assembly 12, wellbore 16, a casing pipe ("casing") 18 extending within and lining the inner surface of wellbore 16, and a tool string 40 extending within casing 18. Surface assembly 12 may comprise any suitable surface equipment for drilling, completing, and/or operating well 20 and may include, in some embodiments, derricks, structures, pumps, electrical/mechanical well control components, etc.

Tool string 40 includes an electric wireline 41 cable including at least one electrical conductor for the operation of system 10. In addition, tool string 40 includes a perforating gun 20 and a setting tool 60. In this embodiment, perforating gun 20 is coupled to the lowermost end of the wireline cable 41 and is configured to emit projectiles or shaped charges (not shown) through the casing 18 and into one of the production zones 32, 34 of formation 30 thereby forming a plurality of perforations 24 that define paths for fluids contained within the production zones 32, 34 to flow into the wellbore 16 during production operations. Perforating gun 20 may be any suitable perforation gun known in the art while still complying with the principles disclosed herein. For example, in some embodiments, gun 20 may comprise a hollow steel carrier (HSC) type perforating gun, a scalloped perforating gun, or a retrievable tubing gun (RTG) type perforating gun. In addition, gun 20 may comprise a wide variety of sizes such as, for example, 2¾", 3⅛", or 3⅜", wherein the above listed size designations correspond to an outer diameter of the perforating gun 20.

In this embodiment setting tool 60 is axially disposed below gun 20 and is configured to set or install a plug or packer 62 within casing 18 during operations to isolate the production zones 32, 34 from one another. Setting tool 60 may be any suitable setting tool known in the art while still complying with the principles disclosed herein. For example, in some embodiments, tool 60 may comprise a #10 or #20 Baker style setting tool. In addition, setting tool 60 may comprise a wide variety of sizes such as, for example, 1.68 in., 2.125 in., 2.75 in., 3.5 in., 3.625 in., or 4 in., wherein the above listed sizes correspond to the overall outer diameter of the tool.

Tool string 40 further comprises a plug and shoot firing head adapter 100 axially disposed between the gun 20 and tool 60 and coupling each of the gun 20 and tool 60 to one another along string 40 during operations. In addition, as will be described in more detail below, adapter 100 also includes at least a portion of the electrical and/or mechanical components necessary to actuate or fire both the setting tool 60 and the perforating gun 20 during operations. Together, the gun 20, adapter 100, and tool 60 may be referred to herein as a plug and shoot assembly 50.

Figure 2:
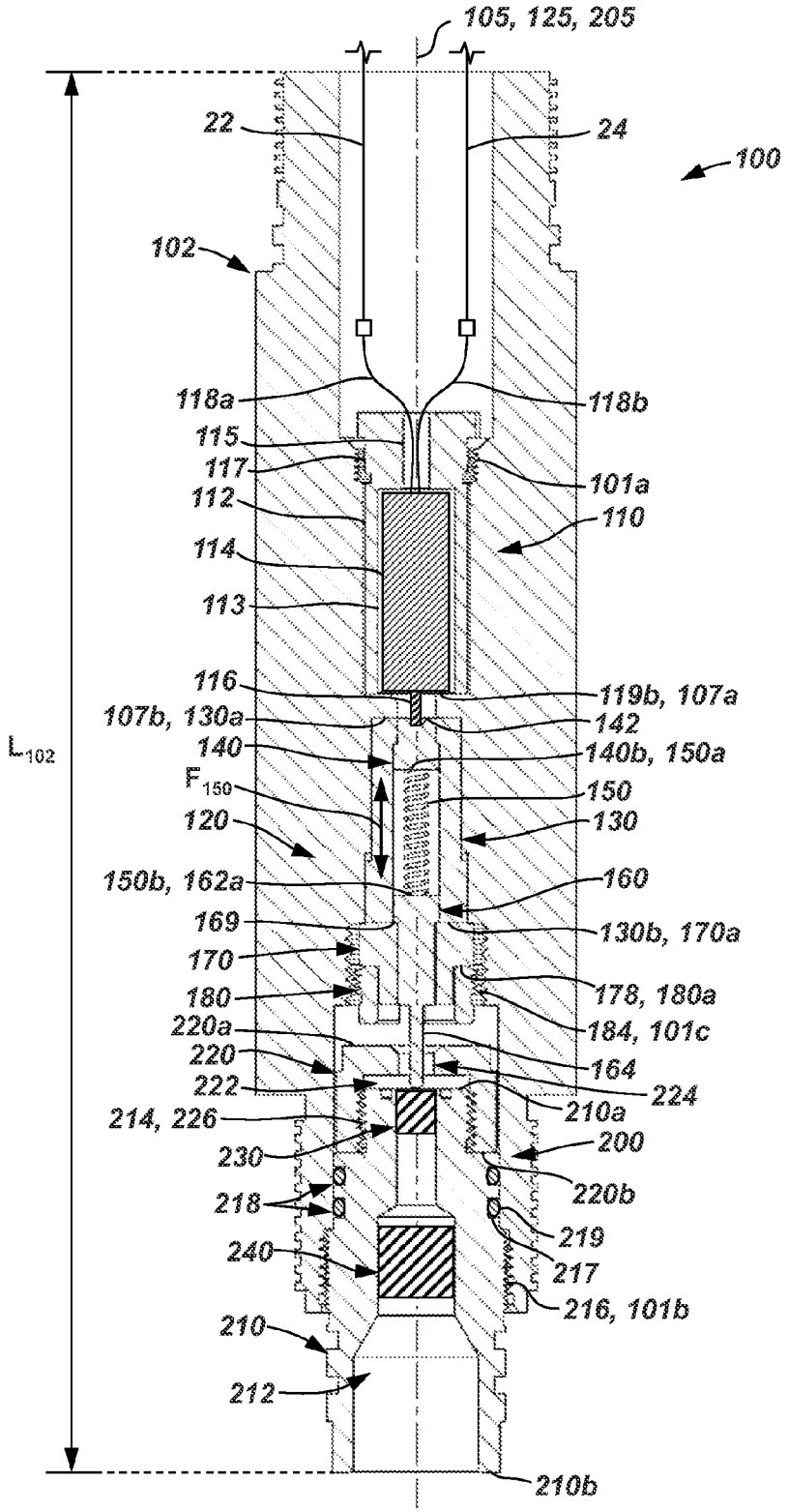
FIG. 2 is a side, schematic, cross-sectional view of the plug and shoot firing head adapter of FIG. 1.

Referring to FIG. 2, plug and shoot firing head adapter 100 is shown. For convenience, perforating gun 20 and setting tool 60 are not shown in FIG. 2; however, it should be understood that both gun 20 and tool 60 would be coupled to either end of adapter 100 during operations, such as is shown in FIG. 1. In this embodiment, assembly 100 comprises a singular outer housing 102, a diode assembly 110, and an internal contact assembly 120. Each of these components and assemblies will now be described in more detail below.

Figure 3:
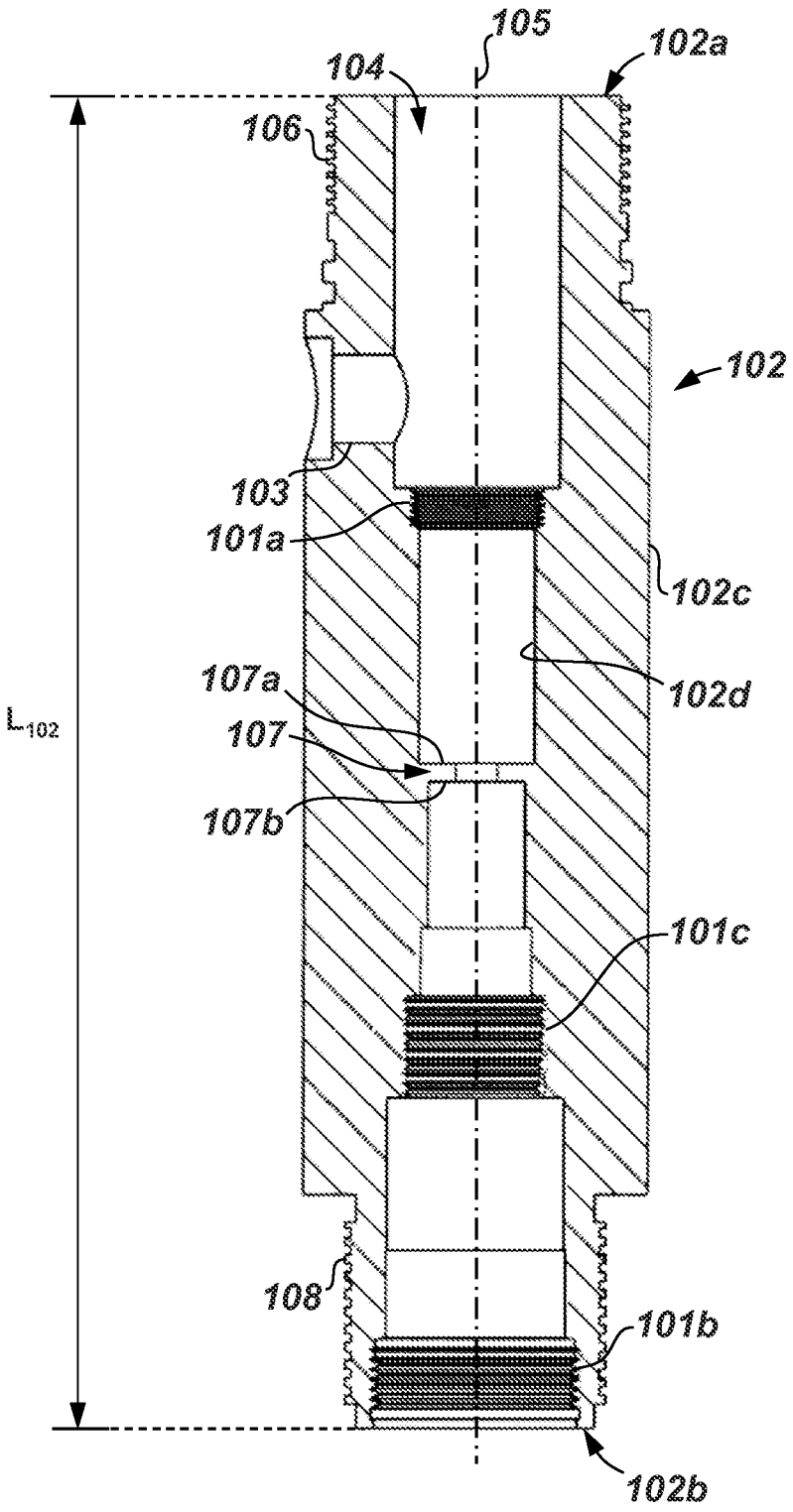
FIG. 3 is a side cross-sectional view of the outer housing of the plug and shoot firing head adapter of FIG. 1.

Referring to FIG. 3, housing 102 has a central longitudinal axis 105, a first or upper end 102*a*, a second or lower end 102*b* opposite the upper end 102*a*, a radially outer surface 102*c* extending between the ends 102*a*, 102*b*, and a radially inner surface 102*d* extending between the ends 102*a*, 102*b* and defining a central passage 104. Upper end 102*a* of housing 102 includes external threads 106 that correspond with a set of internal threads on perforating gun 20, and lower end 102*b* of housing 102 includes a set of external threads 108 that correspond with a set of internal threads on setting tool 60. Also, an access port 103 is disposed between the ends 102*a*, 102*b*, proximate the upper end 102*a* and extends radially between the surfaces 102*c*, 102*d* to provide access into passage 104. In addition, an annular projection 107 extends radially within passage 104 and is axially positioned between the ends 102*a*, 102*b*. Thus, projection 107 defines a first or upper annular shoulder 107*a* and a second or lower annular shoulder 107*b* axially opposite the upper shoulder 107*a*. Further, passage 104 also includes multiple sets of internal threads on the radially inner surface 102*d*. In particular, a first or upper set of internal threads 101*a* is disposed axially between port 103 and projection 107, a second or lower set of internal threads 101*b* is axially disposed at the lower end 102*b*, and a third or intermediate set of internal threads 101*c* is disposed axially between the lower set of threads 101*b* and the projection 107. Further, housing 102 also includes a total length $L_{102}$ measured axially between the ends 102*a*, 102*b*. In some embodiments, length $L_{102}$ is between 5 and 25 in., and is preferably between 10 and 16 in.

Figure 4:
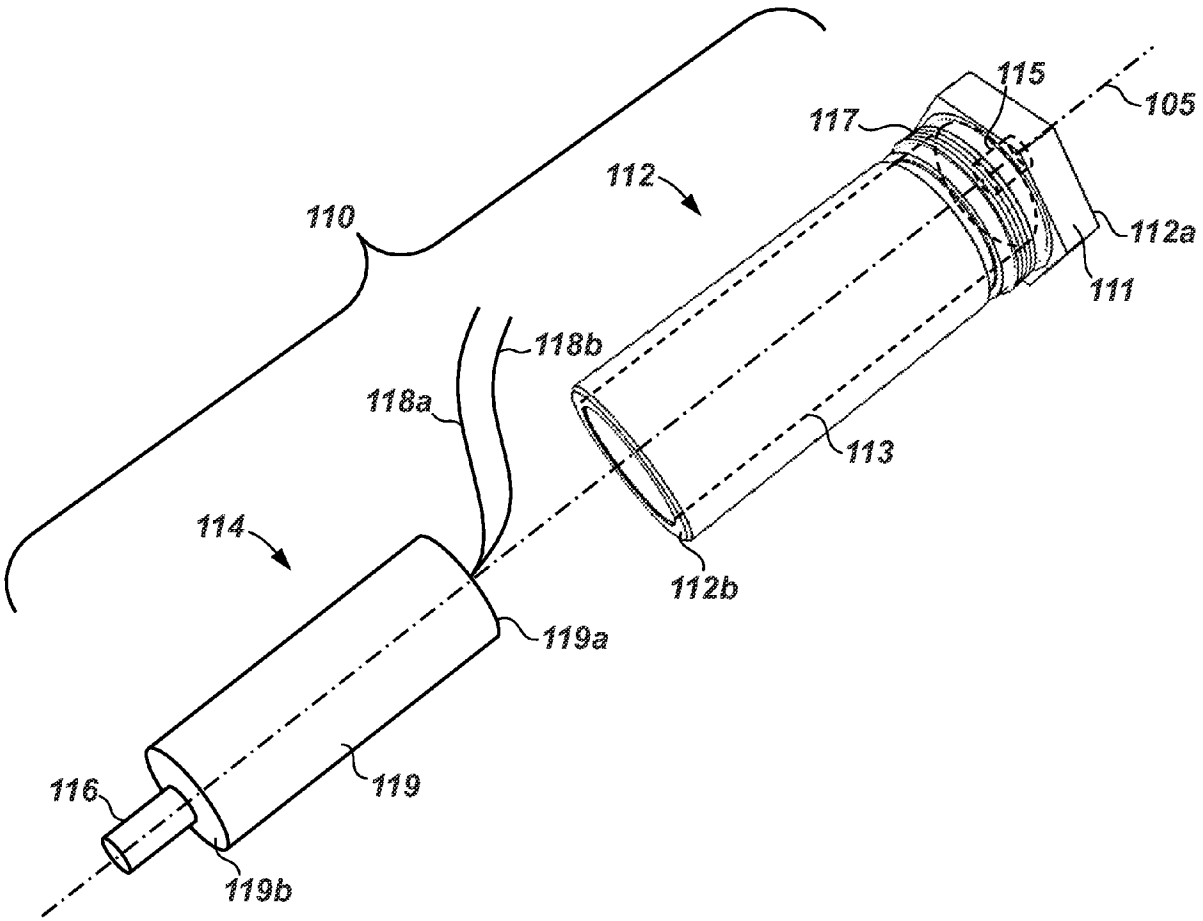
FIG. 4 is an exploded, perspective view of the diode assembly of the plug and shoot firing head adapter of FIG. 1.

Referring now to FIGS. 2 and 4, diode assembly 110 is substantially aligned with the axis 105 during operations and includes a diode housing 112 and a diode member 114. Diode housing 112 includes a first or upper end 112*a*, a second or lower end 112*b* opposite the upper end 112*a*, an internal receptacle 113 extending axially from the lower end 112*b*, and an axially oriented bore 115 extending from receptacle 113 to upper end 112*a* (note: receptacle 113 and bore 115 are each shown with a hidden line in FIG. 4). Housing 112 further includes an engagement portion 111 that has a shape that corresponds with an engagement tool (e.g., a socket wrench) during operations and a set of external threads 117 extending axially from engagement portion 111. In this embodiment, engagement portion 111 comprises a hexagonal head, however, it should be appreciated that engagement portion 111 may comprise any suitable shape that corresponds with a given engagement tool while still complying with the principles disclosed herein.

Diode member 114 comprises a body 119 that includes a first or upper end 119*a*, a second or lower end 119*b* opposite the upper end 119*a*, a first electrical conductor 118*a* extending from the upper end 119*a*, a second electrical conductor 118*b* also extending from the upper end 119*a*, and a contact lead 116 extending axially from the lower end 119*b*. In some embodiments, diode member 114 may comprise any suitable diode or diodes for use with a downhole tool while still complying with the principles disclosed herein. In this embodiment, diode member 114 passes signals of a first polarity (e.g., positive or negative D.C. current) from the first electrical conductor 118*a* to the contact lead 116, and passes signals of a second polarity, that is opposite of the first polarity, from the first electrical conductor 118*a* to the second electrical conductor 118*b*.

As is best shown in FIG. 2, assembly 110 is made up by inserting diode member 114 within receptacle 113 such that conductors 118 extend through bore 115 and contact lead 116 extends axially from the lower end 112*b* of housing 112. Thereafter, the completed assembly 110 is inserted within passage 104 of housing 102 from the upper end 102*a* and is rotated about the axis 105 such that threads 117 engage with the internal threads 101*a* to secure assembly 110 within passage 104. In some embodiments, when assembly 110 is installed within passage 104 of outer housing 102 as described above, the lower end 119*b* of diode body 119 engages or abuts the upper annular shoulder 107*a* of projection 107, previously described.

Figure 5:
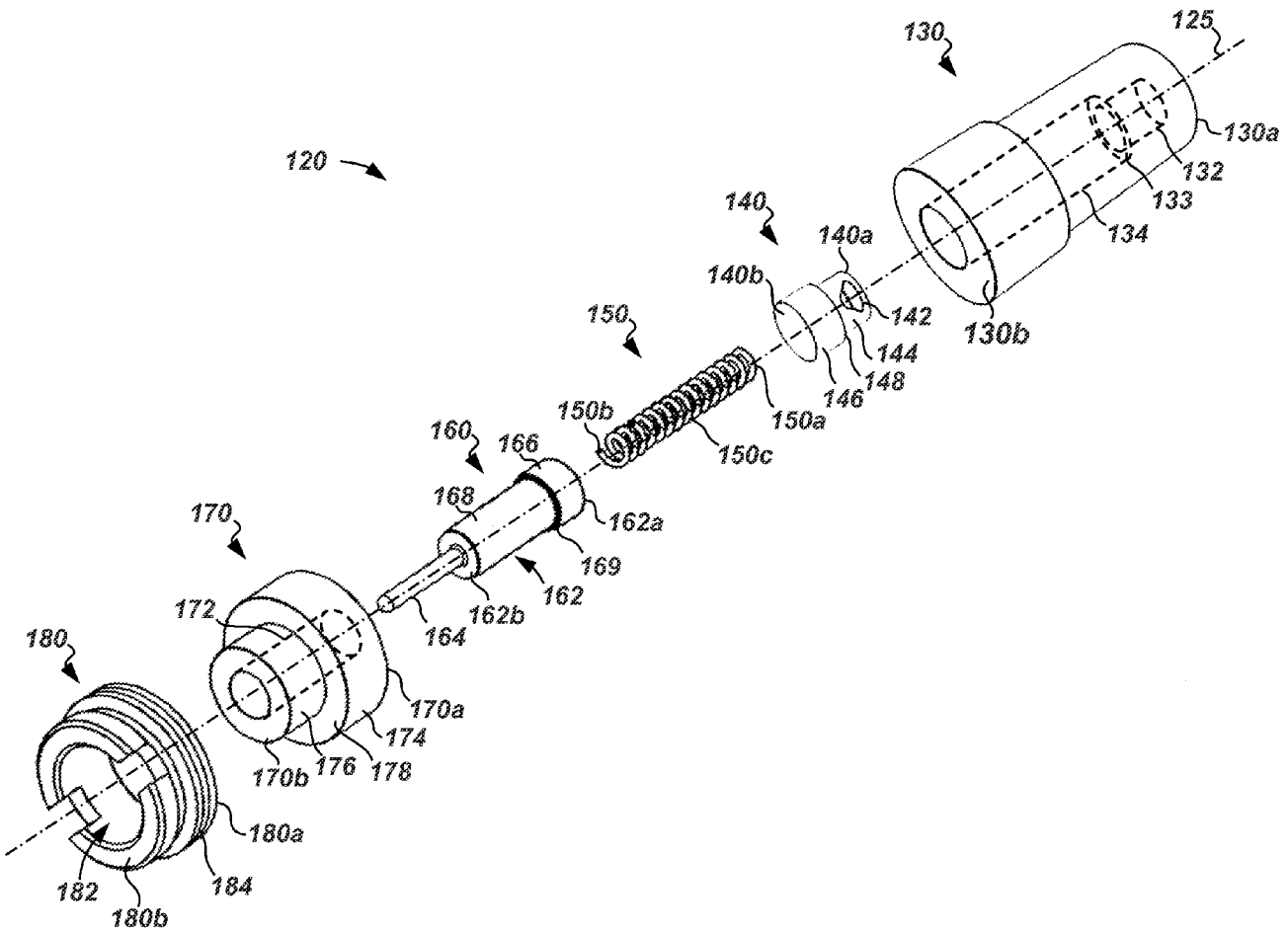
FIG. 5 is an exploded, perspective view of the internal contact assembly of the plug and shoot firing head adapter of FIG. 1.

Referring now to FIGS. 2 and 5, internal contact assembly 120 is generally disposed within central passage 104 of housing 102 axially between the diode assembly 110 and lower end 102*b* and generally includes a central axis 125 that is aligned with the axis 105 of housing 102 during operation, an upper insulator 130, an upper contact 140, a biasing member 150, a lower contact 160, a lower insulator 170, and an internal nut 180.

Upper insulator 130 comprises a first or upper end 130*a*, a second or lower end 130*b* opposite the upper end 130*a*, a first or upper bore 132 extending axially from the upper end 130*a* along the axis 125, and a second or lower bore 134 extending axially from the upper bore 132 to the lower end 130*b* along the axis 125. In this embodiment, the lower bore 134 has a larger inner diameter than the upper bore 132; thus, an inner annular shoulder 133 extends radially between the bores 132, 134 (note: bores 132, 134 and shoulder 133 are shown in FIG. 5 with a hidden line).

Upper contact 140 includes a first or upper end 140*a*, a second or lower end 140*b* opposite the upper end 140*a*, and a receptacle 142 extending axially from the upper end 140*a*. Upper contact 140 also includes a first or upper outer cylindrical surface 144 extending axially from the upper end 140*a*, a second or lower outer cylindrical surface 146 extending axially from the lower end 140*b* that is parallel and radially outward from the surface 144, and an annular shoulder 148 extending radially between the surfaces 144, 146. In this embodiment, receptacle 142 is frustoconically shaped; however, it should be appreciated that in other embodiments, receptacle 142 may comprise any shape while still complying with the principles disclosed herein (note: receptacle 142 is shown with a hidden line in FIG. 5).

In this embodiment, biasing member 150 comprises a contact spring 150 that further includes a first or upper end 150*a*, a second or lower end 150*b* opposite the upper end 150*a*, and a body 150*c* extending helically about the axis 125, between the ends 150*a*, 150*b*. As will be described in more detail below, spring 150 exerts an axially oriented biasing force $F_{150}$ on various other components within assembly 120 (e.g., upper contact 140 and lower contact 160) to maintain adequate contact therebetween during operation. It should be appreciated that any suitable axial biasing member may be used in place of spring 150 while still complying with the principles disclosed herein. For example, in some embodiments, spring 150 may be replaced with a plurality of Belleville washers, Finger washers, wave washers, or some combination thereof.

Lower contact 160 comprises a main body 162 including a first or upper end 162*a*, a second or lower end 162*b* opposite the upper end 162*a*, a first or upper outer cylindrical surface 166 extending axially from the upper end 162*a*, a second or lower outer cylindrical surface 168 extending axially from the lower end 162*b* that is parallel and radially inward from the surface 166, and an outer annular shoulder 169 extending radially between the surfaces 166, 168. Lower contact 160 further includes a contact lead 164 that extends axially from the lower end 162*b* of main body 162.

Lower insulator 170 includes a first or upper end 170*a*, a second or lower end 170*b* opposite the upper end 170*a*, and a throughbore 172 extending axially between the ends 170*a*, 170*b*. Lower insulator 170 also includes a first or upper cylindrical surface 174 extending axially from the upper end 170*a*, a second or lower cylindrical surface 176 extending axially from the lower end 170*b* that is parallel and radially inward from upper cylindrical surface 174, and an outer annular shoulder 178 extending radially between the surfaces 174, 176.

Internal nut 180 includes a first or upper end 180*a*, a second or lower end 180*b* opposite the upper end 180*a*, a throughbore 182 extending between the ends 180*a*, 180*b*, and external threads 184 extending from the end 180*a*. As will be described in more detail below, the internal nut 180 secures internal contact assembly 120 within the internal passage 104 of housing 102 during operation.

Upper contact 140, lower contact 160, and spring 150 may comprise any suitable material that is capable of conducting electrical current therethrough while still complying with the principles disclosed herein. For example, in some embodiments, contacts 140, 160, and spring 150 may comprise stainless steel, carbon steel, or copper bronze. In addition, upper insulator 130 and lower insulator 170 may comprise any suitable electrically insulating material that restricts or eliminates the conduction of electrical current therethrough. For example, in some embodiments, insulators 130, 170 may comprise polyether ether ketone (PEEK), polytetrafluoroethylene (PTFE), or polyphenylene sulfide (PPS).

Referring now to FIGS. 2-5, to assemble plug and shoot firing head adapter 100, diode assembly 110 is assembled and installed within the passage 104 of housing 102 from the upper end 102*a* as previously described. In addition, upper insulator 130 is inserted within the internal passage 104 of housing 102 from the lower end 102*b* until the upper end 130*a* abuts or engages the lower annular shoulder 107*b* of projection 107. Upper contact 140 is inserted within the bores 132, 134 of upper insulator 130 such that the outer annular shoulder 148 on contact 140 engages or abuts the inner annular shoulder 133 within insulator 130. Therefore, when diode assembly 110, insulator 130, and contact 140 are all fully installed within passage 104 of housing 102, the contact lead 116 of diode body 119 extends axially from the lower end 112*b* of diode housing 112 and is received within and engages the receptacle 142 on upper end 140*a* of contact 140.

Spring 150 is inserted within the lower bore 134 of insulator 130 such that the upper end 150*a* engages or abuts the lower end 140*b* of contact 140. Lower contact 160 is then inserted within the lower bore 134 of upper insulator 130 such that the upper end 162*a* of main body 162 engages or abuts the lower end 150*b* of spring 150. Thereafter, lower insulator 170 is inserted within passage 104 of housing 102 such that the upper end 170*a* engages or abuts the lower end 130*b* of upper insulator 130. Moreover, in this embodiment, when lower insulator 170 and lower contact 160 are installed as previously described, the spring 150 is axially compressed within the lower bore 134 of insulator 130 thereby resulting in an axially oriented biasing force $F_{150}$ which biases outer annular shoulder 169 of main body 162 toward upper end 170*a* of lower insulator 170, biases contact lead 164 on lower contact 160 axially from lower end 170*b* through throughbore 172 of insulator 170, and biases receptacle 142 of upper contact 140 into engagement with the contact lead 116 of diode member 114. Thereafter, lock ring 180 is inserted within passage 104 from the lower end 102*b* and is rotated about the axes 105, 125 to engage the external threads 184 with the intermediate set of internal threads 101*c* until the upper end 180*a* abuts or engages the outer annular shoulder 178 of lower insulator 170, thereby axially securing the assembly 120 within passage 104.

Referring again to FIG. 2, in this embodiment, after internal contact assembly 120 is fully installed within the passage 104 of housing 102 as previously described, a setting tool firing assembly 200 is also partially installed within passage 104. In this embodiment, firing assembly 200 includes a central longitudinal axis 205 that is aligned with the axis 105 during operation, a firing head 210, and a firing head cap 220. In particular, firing head 210 includes a first or upper end 210*a*, a second or lower end 210*b* opposite the upper end 210*a*, an internal passage 212 extending between the ends 210*a*, 210*b*, a first or upper set of external threads 214 extending from the upper end 210*a*, and a second or lower set of external threads 216 axially disposed between the upper set of external threads 214 and the lower end 210*b*. Firing head cap 220 includes a first or upper end 220*a*, a second or lower end 220*b* opposite the upper end 220*a*, a receptacle 222 extending axially from the lower end 220*b*, and a bore 224 extending axially from the receptacle 222 to the upper end 220*a*. A set of internal threads 226 extends axially within the receptacle 222 from the lower end 220*b*.

Assembly 200 is constructed by inserting the upper end 210*a* of firing head 210 within the receptacle 222 of firing head cap 220 and rotating one of the head 210 or cap 220 to engage the upper set of external threads 214 on firing head 210 with the internal threads 226 on cap 220. As firing head 210 is threadably engaged to the firing head cap 220, the bore 224 of cap 220 and the internal passage 212 of firing head 210 are substantially aligned with one another along the axis 205. Once fully constructed, the firing assembly 200 is inserted within the passage 104 of housing 102 from the lower end 102*b* and rotated about the aligned axes 105, 205 such that the external threads 216 on firing head 210 engage with the lower set of internal threads 101*b* within passage 104 within housing 102. A plurality of sealing assemblies 218 are also included between the radially inner surface 102*d* within passage 104 and the firing head 210. In particular, each assembly 218 includes a seal gland 217 and sealing member 219 (e.g., an O-ring) disposed therein to restrict the flow of fluids into the passage 104 from the lower end 102*b* during operations.

In this embodiment, assembly 200 further includes a primary igniter 230 and a secondary igniter 240 each installed within the passage 212 of firing head 210. In particular, primary igniter 230 is disposed within passage 212 proximate the upper end 210*a* of firing head 210 such that contact lead 164 of lower contact 160 engages igniter 230 when firing head assembly 200 is installed within passage 104 of housing 102. In addition, secondary igniter 240 is also disposed within passage 212 such that it is axially disposed between the primary igniter 230 and the lower end 210*b*. As will be described in more detail below, in this embodiment, the igniters 230, 240 may comprise any igniter for firing or actuating a setting tool (e.g., setting tool 60) within a subterranean wellbore (e.g., wellbore 16) while still complying with the principles disclosed herein. For example, in some embodiments, the primary igniter may comprise a BP-3 or a BP-4 style igniter and the secondary igniter may comprise a BSI style igniter. Thus, when the firing head assembly 200 is fully engaged within the passage 104 of housing 102, previously described, the contact lead 164 on the lower contact 160 extends through counter bore 224 and into receptacle 222 and is biased into engagement with the primary igniter 230 through the biasing force $F_{150}$ exerted by spring 150, thus completing a conductive signal path from the contact lead 116 on diode 119 to the igniter 230.

Figure 6:
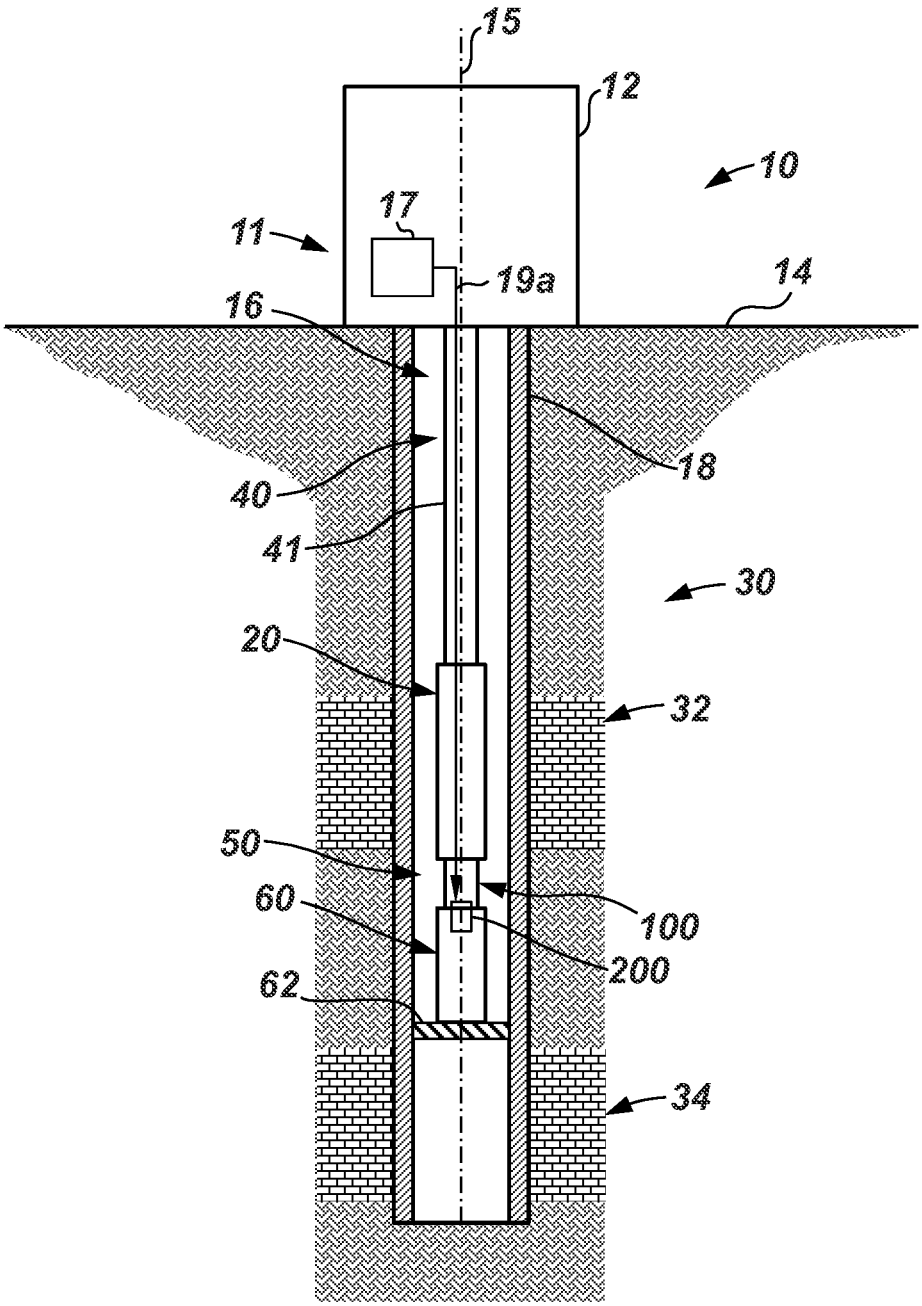
FIGS. 6 and 7 are schematic, partial cross-sectional views of the system of FIG. 1 during completion operations.
Figure 7:
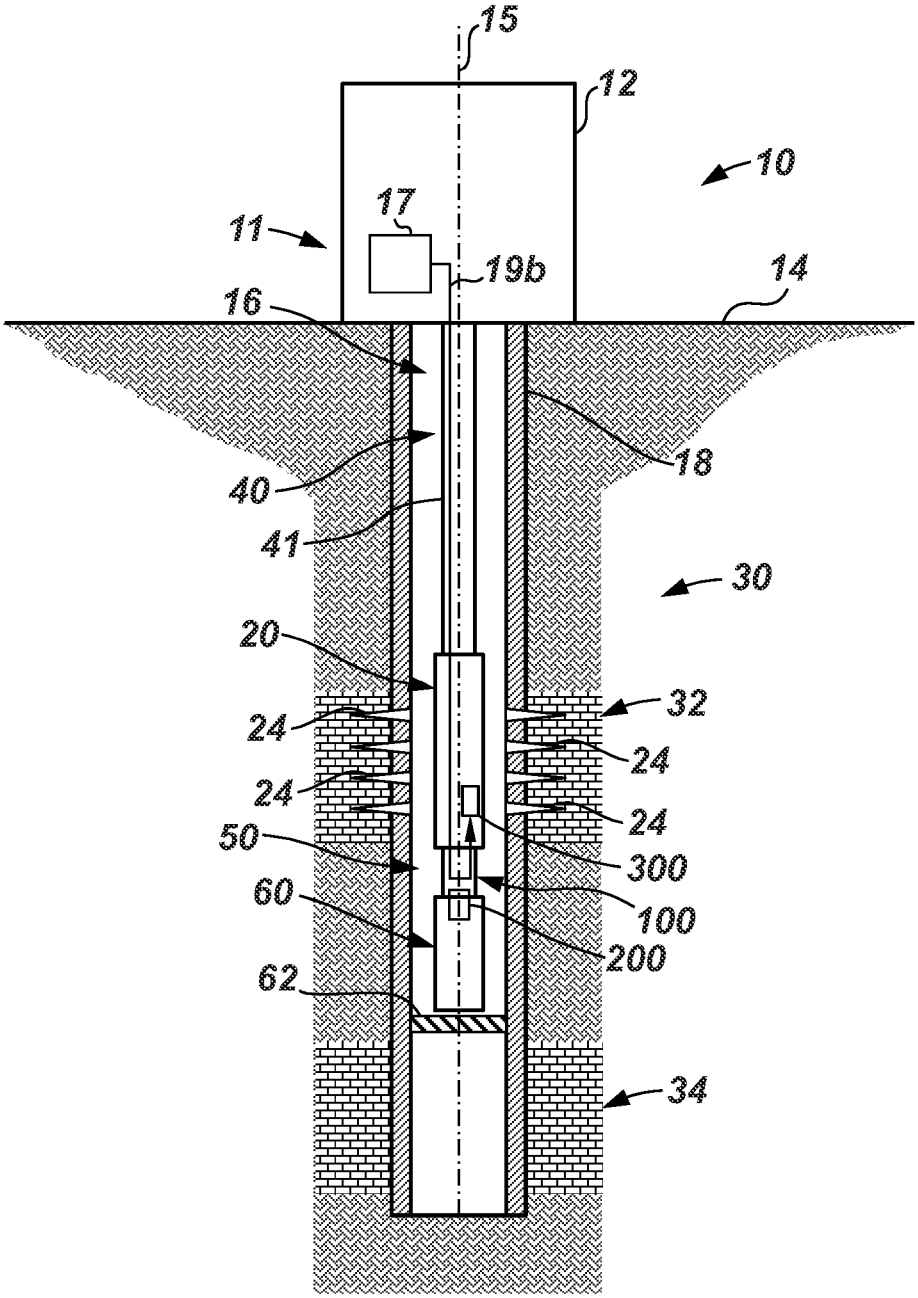

Referring now to FIGS. 2, 6, and 7 in some embodiments, once plug and shoot assembly 50 is fully assembled in the manner described above, the first electrical conductor 118*a* diode member 114 is electrically coupled to a main electrical conductor 22 extending from the surface 14 and through the gun 20 and the second electrical conductor 118*b* is electrically coupled to a second electrical conductor 24 that is electrically coupled to perforating gun firing assembly 300. In at least some embodiments, an operator would make the above described connections by accessing the conductors 118*a*, 118*b*, 22, 24 through the radially oriented port 103 (see FIG. 3) in housing 102, previously described. It should be noted that port 103 is not shown in the cross-section of FIG. 2 for convenience, but is arranged in the same manner to that shown in FIG. 3. In this embodiment, conductor 22 extends from the adapter 100 to the surface 14; however, it should be appreciated that in other embodiments, the main conductor 22 may be electrically coupled to other components within string 40 that are in-turn electrically coupled to a controller 17 disposed at the surface 14 (e.g., on the surface assembly 12).

Referring still to FIGS. 2, 6, and 7, during operation, tool string 40 is lowered within the borehole 16 to both place a plug 62 and perforate the wellbore 16 (e.g., with perforations 24). More specifically, referring first to FIGS. 2 and 6, tool string 40 is lowered within borehole 16 such that setting tool 60 is disposed at a desired depth, which may, in some embodiments, be below one or both of the production zones 32, 34. In this embodiment, tool string 40 is lowered such that the setting tool 60 is axially disposed between the upper production zone 32 and the lower production zone 34. Thereafter, a first firing signal 19*a* is generated within controller 17 and is routed through wireline cable 41 of tool string 40 to cause setting tool 60 to fire and thus install a plug or packer 62 within the wellbore 16. In particular, the first firing signal 19*a* is routed through the main conductor 22 to the first electrical conductor 118*a*, and into the diode member 114. In this embodiment, the first firing signal 19*a* has a first polarity (e.g., minus or negative D.C. current) such that the current is passed from the first electrical conductor 118*a* to the contact lead 116 as previously described. From lead 116, the signal 19*a* is routed through the upper contact 140, contact spring 150, and lower contact 160 as a result of the physical connection between these components. Because the lower contact 160 is biased into engagement with the primary igniter 230 by the spring 150 as previously described, the first firing signal 19*a* is routed to through the lower contact 160 and into the primary igniter 230, thereby causing igniter 230 to fire. The ignition of the primary igniter 230 triggers the secondary igniter 240 to fire which in turn actuates setting tool 60 to install plug 62 within wellbore 16. For example, in some embodiments, secondary igniter 240 ignites a powder charge which produces gases that cause plug 62 to actuate and thus engage with the inner walls of wellbore 16.

Referring now to FIGS. 2 and 7, once plug 62 is installed within wellbore 16, tool string 40 is axially shifted within wellbore 16 to align the perforating gun 20 with one of the production zones 32, 34 of formation 30. In this embodiment, the tool string 40 is axially shifted within wellbore 16 to align the perforating gun 20 with the upper production zone 32. Once aligned, a second firing signal 19*b* is generated within controller 17 at the surface 14 (e.g., at the surface assembly 12) and is routed downhole to fire the gun 20 such that projectiles or shaped charges (not shown) are emitted from gun 20 and penetrate both the casing 18 and production zone 32 to form a plurality of perforations 24. In particular, the second firing signal 19*b* is routed through the main conductor 22 to the first electrical conductor 118*a* and into the diode member 114. In this embodiment, the second firing signal 19*b* has a second polarity that is opposite the first polarity of the first firing signal 19*a* (see FIG. 6) such that when the second firing signal 19*b* enters the diode member 114 through the first electrical conductor 118*a*, it is redirected away from the contact lead 116 and into the second electrical conductor 118*b*. Thereafter the second firing signal passes back into the perforating gun 20 where it activates the perforating gun firing assembly 300 disposed therein to fire the gun 20 and perforate the wellbore 116 with perforations 24.

In the manner described, through use of firing head adapter (e.g., adapter 100) in accordance with the principles disclosed herein, a setting tool (e.g., setting tool 60) may be coupled to a perforating gun (e.g., gun 20) along a tool string (e.g., tool string 40) with a single integrated housing such that the overall length of the tool string may be reduced. Additionally, through use of a firing head adapter (e.g., adapter 100) in accordance with the principles disclosed herein, the number of components required to for carrying out combined perforation and plugging activities may be reduced, thus reducing the failure rate and complexity of such operations.

While embodiments disclosed herein have been described in connection with well 11 disposed on-shore, it should be appreciated that other embodiments may be employed with an off-shore well while still complying with the principles disclosed herein. In addition, it should be appreciated that in other embodiments, the location, type, and specific arrangement of the diode assembly 110, internal contact assembly 120, and/or firing head assembly 200 may be greatly varied while still complying with the principles disclosed herein. For example, in some embodiments, the upper insulator 130 and the lower insulator 170 may be substantially identical in shape and size such that the lower insulator 170 is inverted relative to the upper insulator 130. As another example, in some embodiments, the firing head assembly 200 is not disposed within the passage 104 of housing 102, while in other embodiments, the firing head assembly 200 is fully disposed within the passage 104 of housing 102. Further, while embodiments disclosed herein have included an internal contact assembly 120, it should be appreciated that in other embodiments, no internal contact assembly 120 is included and the contact lead 116 contacts the primary igniter 230 directly.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A plug and shoot assembly, comprising:

a perforating gun to perforate a subterranean wellbore;

a setting tool to install a plug within the wellbore; and an adapter configured to connect to each of the perforating gun and the setting tool, wherein the adapter includes:

a single outer housing, the outer housing including a first end to directly connect to the perforating gun, a second end to directly connect to the setting tool, and an internal passage extending between the first end and the second end of the outer housing;

a diode housing disposed within the internal passage and configured to receive a diode member, the diode member including a first electrical conductor, a second electrical conductor, and a first contact lead;

wherein the diode housing includes a first receptacle and a bore extending from the first receptacle; and wherein the diode member is disposed within the first receptacle such that the first contact lead extends from the first receptacle and the first electrical conductor and the second electrical conductor each extend through the bore; and an internal contact assembly also disposed within the internal passage;

wherein the internal contact assembly is configured to route an electrical signal to cause the setting tool to install a plug within the wellbore; and wherein the internal contact assembly further includes:

an upper contact including a second receptacle;

a lower contact; and a biasing member in contact with each of the upper contact and the lower contact and configured to bias the second receptacle into engagement with the contact lead of the diode member;

wherein each of the upper contact, the lower contact, and the biasing member are configured to conduct electrical current therethrough.

2. The plug and shoot assembly of claim 1, wherein the lower contact further comprises a second contact lead, and wherein the biasing member is configured to bias the second contact lead into engagement with an igniter disposed within a first firing assembly, wherein the first firing assembly is configured to cause the setting tool to install a plug within the subterranean wellbore.

3. The plug and shoot assembly of claim 2, wherein the second electrical conductor of the diode member is electrically coupled to a second firing assembly, wherein the second firing assembly is configured to cause the perforating gun to perforate the wellbore.

4. The plug and shoot assembly of claim 2, wherein the biasing member comprises a helical spring.

5. The plug and shoot assembly of claim 1, further comprising an insulator disposed within the internal passage of the outer housing and including an internal throughbore to at least partially house the upper contact, the biasing member, and the lower contact, wherein the insulator comprises an electrically insulating material.

6. The plug and shoot assembly of claim 1, wherein the first end of the outer housing comprises a first set of external threads to engage with a corresponding set of internal threads on the perforating gun, wherein the second end of the outer housing comprises a second set of external threads to engage with a corresponding set of internal threads on the setting tool.

7. A plug and shoot firing head adapter for a downhole tool string, the adapter comprising:

a single outer housing, the outer housing including a first end to directly connect to a perforating gun, a second end to directly connect to a setting tool, and an internal passage extending between the first end and the second end of the outer housing;

a diode housing disposed within the internal passage and configured to receive a diode member that is further configured to selectively route an electrical signal to cause the setting tool to install a plug within the wellbore and to cause the perforating gun to perforate the wellbore; and an internal contact assembly disposed within the internal passage, wherein the internal contact assembly is electrically coupled to the setting tool;

wherein the diode member includes a first electrical conductor, a second electrical conductor, and a first contact lead;

wherein the diode housing includes a first receptacle and a bore extending from the first receptacle; and wherein the diode member is configured to be disposed within the first receptacle such that the first contact lead extends from the first receptacle and the first electrical conductor and the second electrical conductor each extend through the bore;

wherein the internal contact assembly further includes:

an upper contact including a second receptacle;

a lower contact; and a biasing member in contact with each of the upper contact and the lower contact and configured to bias the second receptacle into engagement with the contact lead of the diode member;

wherein each of the upper contact, the lower contact, and the biasing member are configured to conduct electrical current therethrough.

8. The adapter of claim 7, wherein the lower contact further comprises a second contact lead, and wherein the biasing member is configured to bias the second contact lead into engagement with an igniter disposed within a first firing assembly, wherein the first firing assembly is configured to cause the setting tool to install a plug within the subterranean wellbore.

9. The plug and shoot assembly of claim 8, wherein the second electrical conductor of the diode member is electrically coupled to a second firing assembly, wherein the second firing assembly is configured to cause the perforating gun to perforate the wellbore.

10. The adapter of claim 8, wherein the biasing member comprises a helical spring.

11. The adapter of claim 7, further comprising an insulator disposed within the internal passage of the outer housing and including an internal throughbore to at least partially house the upper contact, the biasing member, and the lower contact, wherein the insulator comprises an electrically insulating material.

12. The adapter of claim 7, wherein the first end of the outer housing comprises a first set of external threads to engage with a corresponding set of internal threads on the perforating gun, wherein the second end of the outer housing comprises a second set of external threads to engage with a corresponding set of internal threads on the setting tool.

13. A plug and shoot assembly, comprising:

a perforating gun to perforate a subterranean wellbore;

a setting tool to install a plug within the subterranean wellbore; and an adapter configured to connect the perforating gun and the setting tool to one another, wherein the adapter includes:

a single outer housing, the outer housing having a central axis and including a first end, a second end opposite the first end, and an internal passage extending between the first end and the second end, wherein the first end comprises a first set of external threads to engage with a corresponding set of internal threads on the perforating gun, wherein the second end comprises a second set of external threads to engage with a corresponding set of internal threads on the setting tool;

a diode assembly configured to be disposed within the internal passage; and an internal contact assembly also configured to be disposed within the internal passage axially below the diode assembly, the internal contact assembly including:

an upper contact;

a lower contact; and a biasing member in contact with each of the upper contact and the lower contact;

wherein each of the upper contact, the lower contact, and the biasing member are configured to conduct electrical current therethrough;

wherein the diode assembly is configured to route an electrical signal of a first polarity to a first firing assembly to cause the setting tool to install a plug within the wellbore and to route an electrical signal of a second polarity to a second firing assembly to cause the perforating gun to perforate the wellbore;

wherein the first polarity is opposite the second polarity.

* * * * *